United States Patent [19]

Moreau

[11] Patent Number: 4,685,742

[45] Date of Patent: Aug. 11, 1987

[54] EQUIPMENT FOR EXTRACTING ORES FROM SEA BEDS

[75] Inventor: Jean-Pierre L. Moreau, La Panne, Belgium

[73] Assignee: Chantiers du Nord et de la Mediterranee, Paris, France

[21] Appl. No.: 704,980

[22] Filed: Feb. 25, 1985

[30] Foreign Application Priority Data

Feb. 24, 1984 [FR] France ..... 84 02813

[51] Int. Cl.[4] ..... E02F 7/00; E02F 5/00

[52] U.S. Cl. ..... 299/8; 299/9; 37/DIG. 8

[58] Field of Search ..... 299/8, 9; 37/DIG. 8

[56] References Cited

U.S. PATENT DOCUMENTS

| | | | |
|---|---|---|---|
| 3,971,593 | 7/1976 | Porte et al. | 299/8 |
| 3,975,054 | 8/1976 | Brockett, III et al. | 299/8 |
| 4,030,216 | 6/1977 | Willums | 37/DIG. 8 X |
| 4,040,667 | 8/1977 | Tax et al. | 299/8 |
| 4,070,061 | 1/1978 | Obolensky | 37/DIG. 8 X |
| 4,232,903 | 11/1980 | Welling et al. | 299/8 |
| 4,368,923 | 1/1983 | Handa et al. | 299/8 |
| 4,503,629 | 3/1985 | Uchida | 37/DIG. 8 X |

FOREIGN PATENT DOCUMENTS 522366 12/1976 U.S.S.R. ..... 299/8

OTHER PUBLICATIONS

Mero, John L., "Economics of Deep-Sea Mining", 9/1961.

*Primary Examiner*—Stephen J. Novosad
*Assistant Examiner*—Michael A. Goodwin
*Attorney, Agent, or Firm*—Pollock, Vande Sande & Priddy

[57] ABSTRACT

Apparatus for extracting ores from the sea bed, comprising a surface ship (1) supplying the power required for the operation of the under-water assembly and for storing the ore, a relay unit (30) connected to the ship (1) by a conduit (3, 4) for raising the ore and including ore storage, sorting and intermediate washing facilities and means for raising the ore, and vehicles (50) for travelling along the sea bottom (2) and each comprising a propulsion system and an ore pick up, washing and treating system. The apparatus also comprises an intermediate under-water station (20) interposed between the surface ship (1) and the relay unit (30) and immersed at a predetermined depth below the level of the water, so as to be always unaffected by the swell. The invention is applicable to the picking up of polymetallic nodules at great depth.

11 Claims, 8 Drawing Figures

EQUIPMENT FOR EXTRACTING ORES FROM SEA BEDS

FIELD OF THE INVENTION

The present invention relates generally to equipment for the exploitation and extraction of large quantities of ores, e.g., polymetallic nodules which exist on sea bottoms.

BACKGROUND OF THE INVENTION

It is known that extremely large quantities of ores exist on the sea bottom and that, in particular, mineral rich nodules exist in many parts of the world. They contain essentially manganese and also other metals such as iron, nickel, molybdenum, cobalt and copper, and therefore constitute a very sought-after inexhaustible source of ores. However, these nodules are usualy found at great depths, e.g., at 5500 meters below the surface of the sea, so that extremely difficult technological problems must be solved for their exploitation.

Indeed, the picking up of the nodules on the sea bottom in deep oceans, and then the raising of these nodules over such a distance to the surface, is an operation difficult to carry out in an efficient manner since, at this depth, the pressure is high and the action of the wind and swell on the surface and the deep-sea currents must moreover be taken into account.

For the extraction of these nodules, apparatus or methods exist which employ, in combination with a ship or platform on the surface, suction systems, bucket dredgers or like means, but these various devices have not given full satisfaction both because of difficulties encountered in the precise control or guidance of the apparatus at these depths, and because of the power required for raising the nodules from the bottom up to the surface of the sea.

Apparatus is also known which employs devices capable of travelling over the sea bottom and equipped with nodule pick up and storing means. These devices may be pulled along by a cable from the surface or be self-propelled and previously programmed to operate on the sea bottom. Some thereof have their own source of energy and can be moreover designed in such manner as to effect not only the taking up of the nodules but also the raising thereof to the surface.

However, these various equipments have the drawback of not permitting sufficient efficiency in the picking up of the ore in a given period of time and for a given area passed over.

SUMMARY OF THE INVENTION

The present invention relates in particular to equipment for extracting ore from sea bottoms at a great depth which markedly optimizes the efficiency of the exploitation of a deposit and provides a necessary flexibility of utilization as a function of the conditions of exploitation.

The equipment therefore comprises:

a surface ship providing the energy required for the operation of the under-water part and ensuring the storage of the ore, a relay unit connected to the ship by an ore-raising conduit and including ore storing, sorting and intermediate washing means and means for raising said ore, an intermediate under-water station interposed between the surface ship and the relay unit and connected to the relay unit by an ore-raising conduit and connected to the ship by a loading conduit, and vehicles travelling over the sea bottom and each comprising a propulsion system and an ore picking up, washing and treating system.

According to the invention, the intermediate submarine station immersed at a certain depth below the level of the water so as to be always unaffected by the swell, comprises independent means for maintaining the relay unit and the picking up vehicles in operation and for ensuring the raising and the storing of the ore in the case of disconnection of the connection with the surface ship.

BRIEF DESCRIPTION OF THE DRAWINGS

The features of the invention will be more particularly apparent from the following description which is given merely by way of example with reference to the accompanying drawings, in which.

Figure 1:
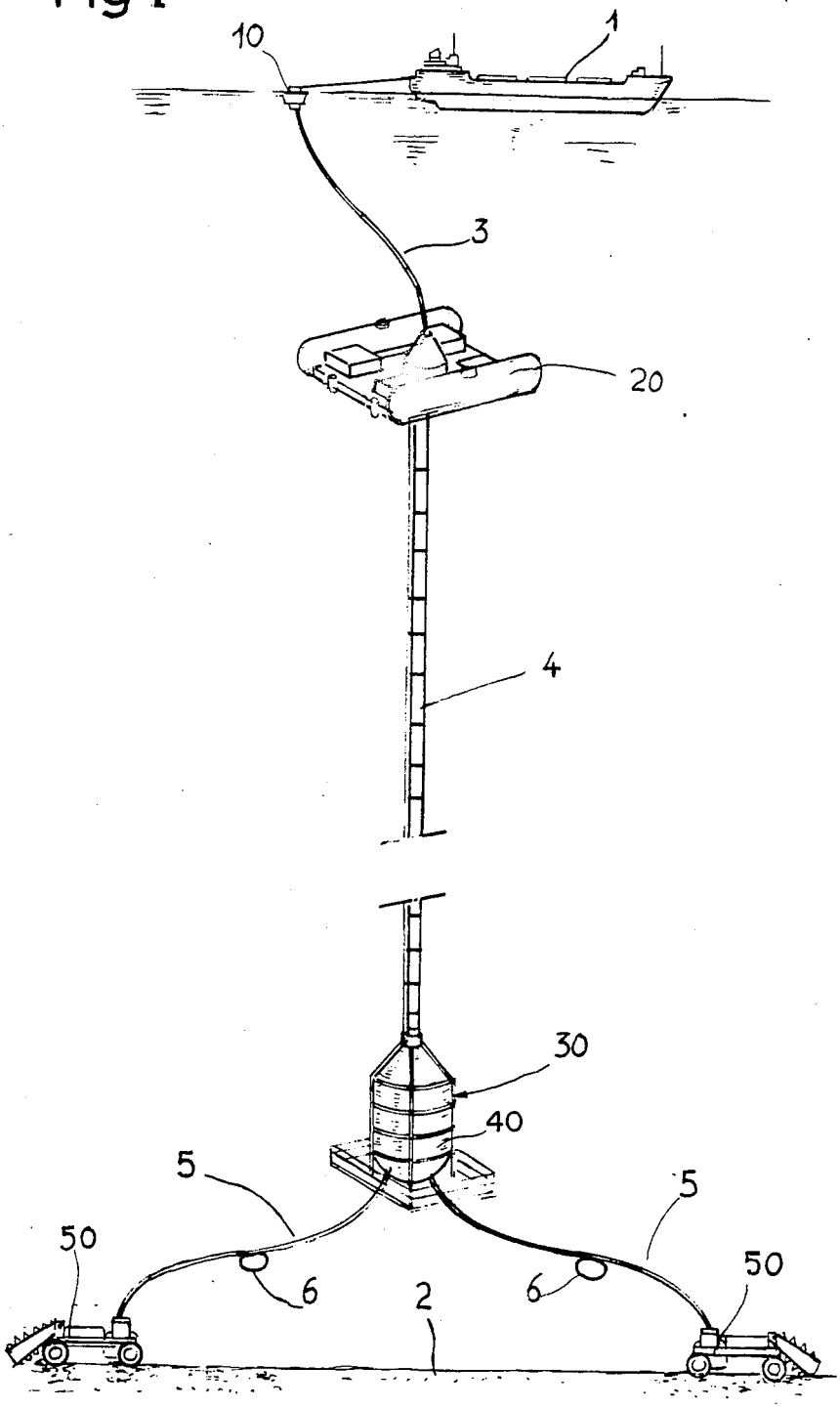
FIG. 1 shows diagrammatically the whole of the ore-extracting equipment according to an embodiment of the invention.

The equipment for exploiting and picking up ore from sea bottoms at great depths shown in FIG. 1 comprises a ship 1 floating on the surface of the water, and a plurality of ore picking up vehicles 50 which travel over the sea bottom 2 for example at 5500 meters below the level of the sea. The connection between the ship 1 and the vehicles 50 for supplying the energy and for raising the ore is achieved in the following manner. First of all, the ship 1 is connected by a flexible conduit 3 to an underwater station 20 immersed at a depth on the order of 300 to 350 m which itself supports by a rigid conduit 4 a relay unit 30 immersed at a depth of about 4500 to 5000 meters. Each vehicle 50 is connected to the relay unit 30 by an assembly of cables and pipes 5 ensuring the transmission of the energy and the control of the drives and the raising of the ore up to the relay unit 30. These cables and pipes 5 are maintained by floats 6 in such manner as to avoid transmitting random forces to the vehicles 50.

The ship 1 which constitutes the living base provides the energy to the various motors and pumps required for operating the whole of the equipment and stores the ore collected between two visits of the ore transporting ships.

Figure 2:
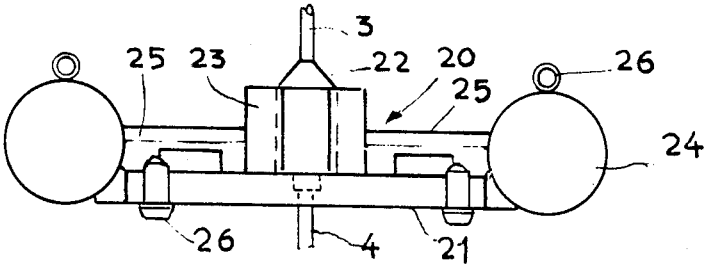
FIGS. 2 and 3 are two diagrammatic views of the intermediate underwater station of the equipment.
Figure 3:
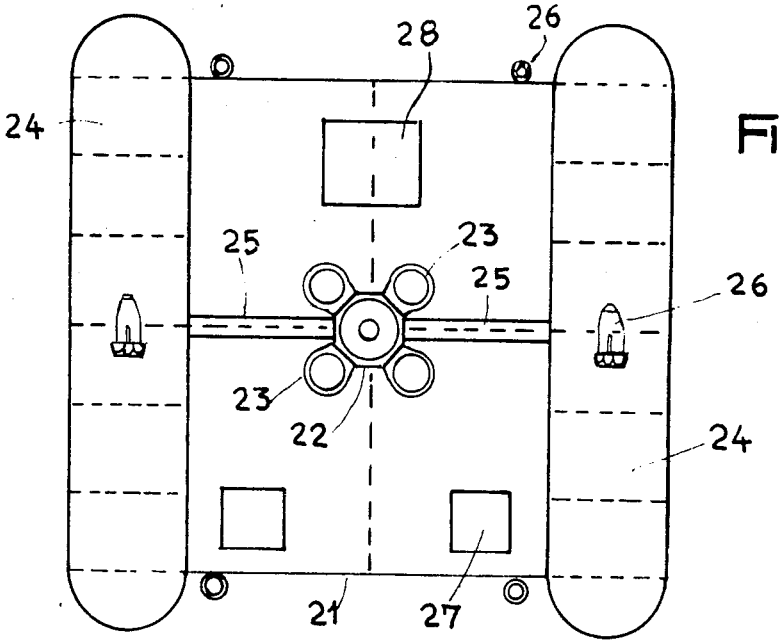

The intermediate under-water station 20, which is shown in more detail in FIGS. 2 and 3, is located about 300 to 350 meters below the level of the water so as to be unaffected by the effects of the swell. It mainly comprises a deck 21 on which are mounted a connection box 22 for the connection between the flexible conduit 3 and the rigid conduit 4, and a plurality of primary pumps 23 capable of pumping the mixture of ores and sea water from the relay unit 30 through the conduit 4 and discharging this mixture up to the surface ship 1 through the conduit 3. A longitudinal float 24 is mounted on each side of the deck 21 for maintaining the station at the required altitude. These floats may optionally serve as a buffer storage means for the ore, for an operation of about 10 or so hours, of a volume of for example 3000

$m^3$ per float, in particular in the case of disconnection of the connection with the ship, as will be understood hereinafter. For this purpose, each float is connected by a pipe 25 to the connection box 22.

This under-water station 20 also comprises a system of longitudinal and vertical propulsion means 26 for keeping the course and altitude of the station and a control system 27 receiving instructions from the ship and controlling the pumps 23 and the propulsion means 26. The electricity required for the operation of the station is supplied by the ship 1 but, in the event of a disconnection of the connection with the ship, one or more reserve electric generator units 28 mounted on the deck 21 supply the required electricity.

The relay unit 30 located at 4500 to 5000 meters below the level of the water is coupled to the under-water station 20 by the raising conduit 4 and cables (not shown). It mainly groups everything which is not indispensible on the vehicles 50 so as to limit the energy to be supplied to these vehicles to the strict minimum.

Figure 4:
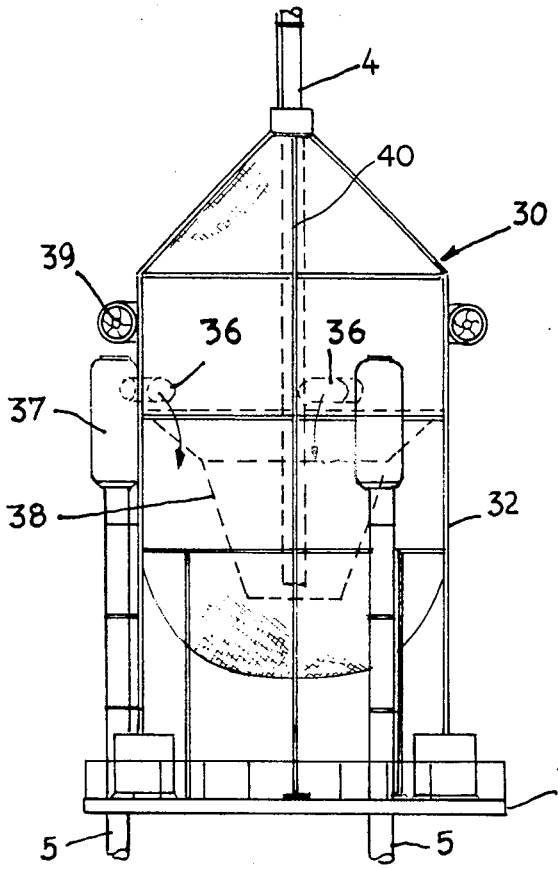
FIGS. 4 and 5 are two diagrammatic views of the under-water relay unit of the equipment.
Figure 5:
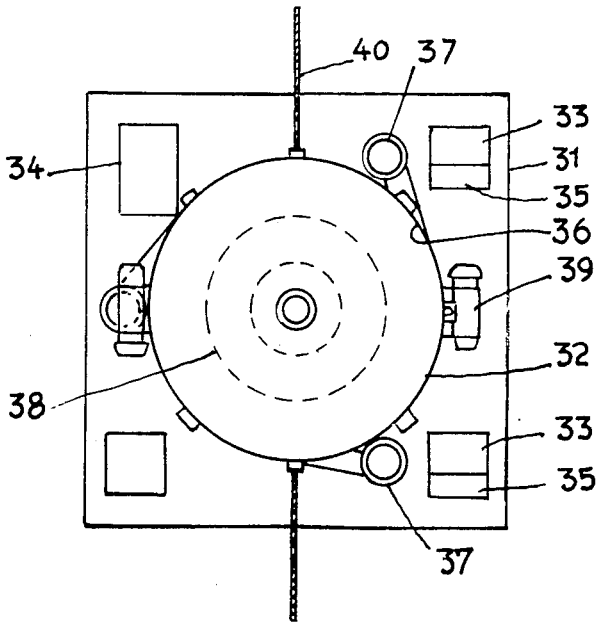

This relay unit (FIGS. 4 and 5) comprises a platform 31 supporting a silo 32 for providing among other purposes a buffer storage of about 500 tons of ore between the vehicles 50 and the station 20. Also mounted on this platform are hydraulic sea water units 33 and a control and driving system 34. The hydraulic unit 33 supplying water under pressure for actuating the hydraulic motors of the vehicles 50 are driven by electric motors 35 receiving the power from the ship through the under-water station 20. The control system 34 is capable of ensuring a certain number of preprogrammed functions and of carrying out the instructions given from the ship in accordance with elements transmitted to the latter.

The silo 32 has in its upper part multiple tangential inlets 36 which form a whirl. Each of these inlets communicates through a pump 37 with a pipe 5 for raising the ore into the silo from a vehicle 50. Each inlet 36 is therefore connected to a vehicle so as to enable the ore to be raised from a plurality of vehicles simultaneously. Placed below the inlets 36 inside the silo 32 is a downwardly convergent cone grid 38 for the purpose of effecting under the effect of gravity the sorting out and the final washing of the ore. The upper conduit 4 for raising the ore to the ship through the station 20 extends into the silo 32 and opens out above the grid 38. In order to keep the course of the relay unit 30 in respect to the station 20, this relay unit is provided with propulsion means 39 and vertical stabilizers 40 disposed on each side of the silo 32.

Figure 8:
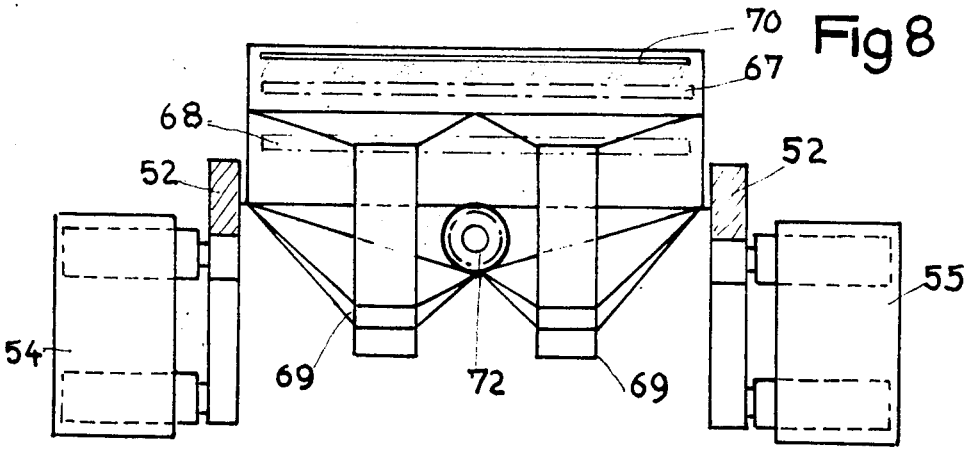
FIGS. 6, 7 and 8 are different views of the ore picking up vehicle.
Figure 6:
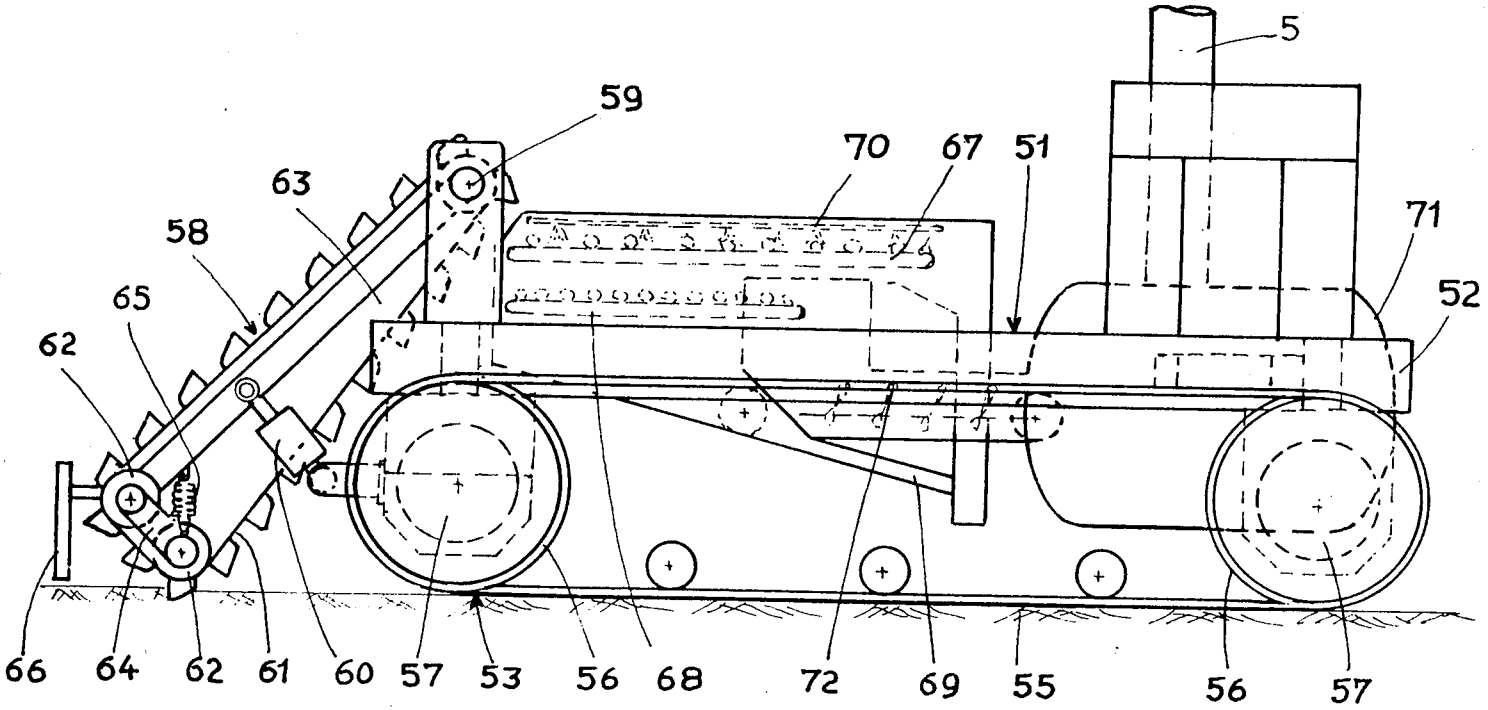
Figure 7:
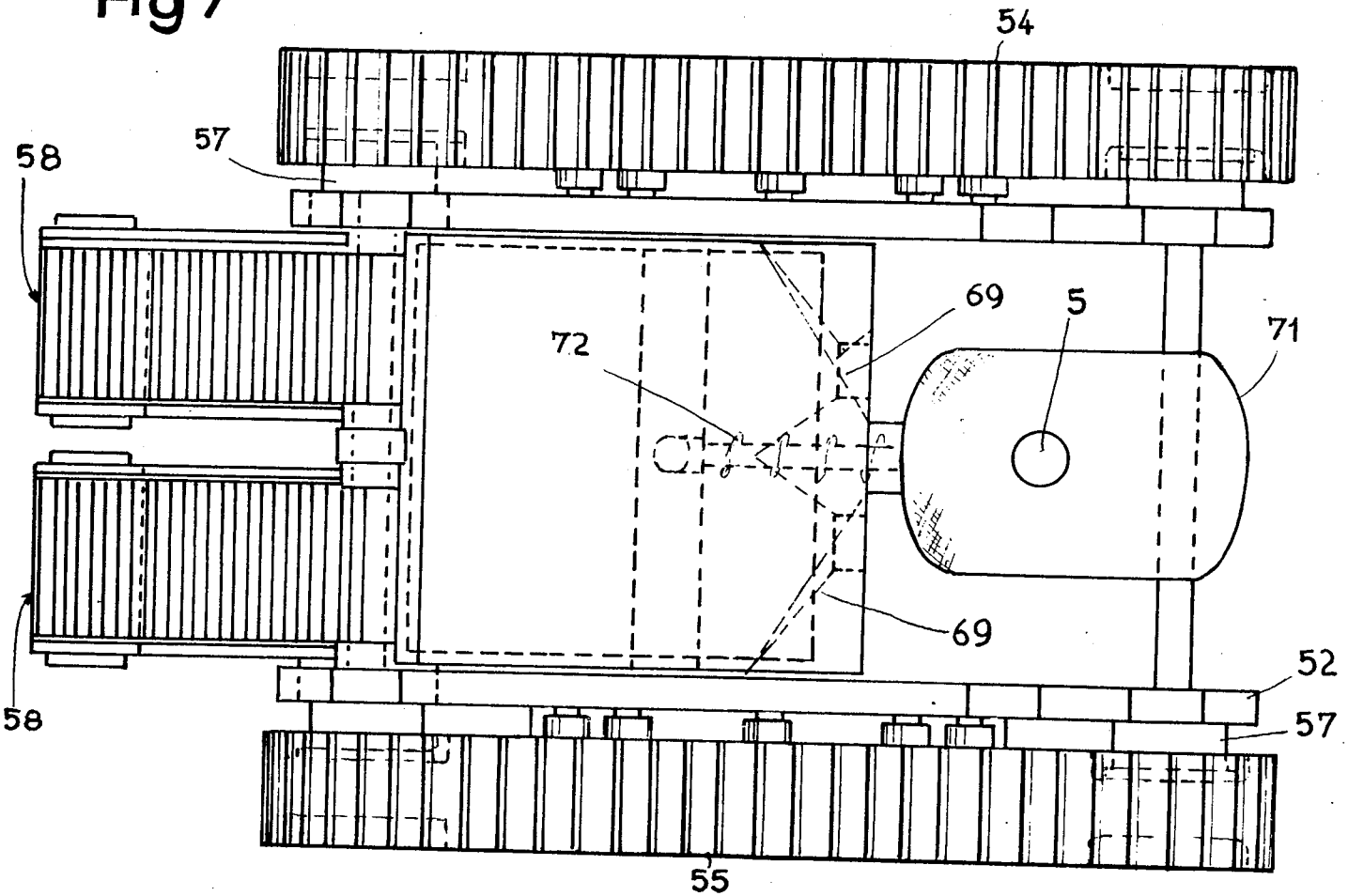

The under-water ore, for example polymetallic nodules, is picked up by the vehicles 50 (FIGS. 6, 7 and 8) which mainly comprise a support chassis, a propulsion system, an ore picking up system, and an ore washing and treating system.

The chassis 51, formed by metal girders 52 provided internally with foam, supports the various elements of the vehicle and in particular the propulsion system 53. This propulsion system 53 is, for example, formed by a pair of articulated tracks 54 and 55 located on each side of the chassis 51. Each track 54 or 55 is driven by wheels 56 which are driven by hydraulic motors 57 disposed in the wheel rim. Water under pressure for the hydraulic motors 57 is supplied by the hydraulic units 33 of the relay unit 30. Each wheel 56 is driven by a hydraulic motor 57 in such manner as to afford great mobility of the vehicle. The tracks 54, 55 having a mixed metal and composite structure are provided with internal grooves for connection with the wheels 56 and external grooves for ensuring a suitable grip on the ground.

Mounted on the chassis 51 in front of the vehicle is the ore picking up system which comprises two trains of bucket chains 58 disposed in alignment so as to cover a sufficient width.

The penetration of the ground is facilitated by the presence of teeth provided in the buckets and the latter are provided with apertures so as to avoid unnecessarily raising water and mud in suspension. Each train of bucket chains 58 is independent and is pivotable about a shaft 59 located in the upper part. This pivoting is controlled by a jack 60 and enables each train to be adapted to the configuration of the ground. Further, the endless chain 61 supports the buckets and extends around wheels 62 mounted on arms 63, 64 which are interconnected in a resiliently yieldable manner, for example by springs 65, so that, when a bucket strikes against an obstacle (large stone or rock), the lower arm 64 rises and the bucket passes over the obstacle instead of becoming wedged against it. The protection of the buckets is also ensured by bumpers 66.

The buckets empty their contents into a treating and washing system comprising two superimposed conveyor belts 67, 68 which constitute a grid arrangement having calibrated gaps or meshes for the selection of the nodules. The excessively large nodules and the sediments are discharged into a hopper 69. A first washing is carried out by racks 70 located above the conveyor belt 67. The nodules selected in this way are then conveyed to a tank 71 by a screw 72 in which the gangue which might exist is removed from the nodules and in which they undergo a second washing. The tank 71 is connected to the pipe 5 for raising the nodules to the relay unit 30.

Each vehicle 50 is of course equipped with an under-water observation device, a detecting device or an acoustic viewing system so as to ensure reliable and easy conditions of operation even in the case where the water is cloudy or visibility is low.

The ore picking up equipment operates in the following manner:

The assembly of the under-water station 20 and relay unit 30 connected to said station by the conduit 4 is maintained, by means of the propulsion means 26 and possibly by ballasts, in such a position that the station 20 is located about 300 to 350 meters below the level of the water. This assembly may also travel about in accordance with instructions given from the ship 1. Further, the crew on the ship controls the operation of the equipment and can intervene at any moment.

Further, the power required for the operation of the equipment, and in particular of the various elements of the vehicles 50, is supplied by the ship 1 and the water under pressure for the propulsion of said vehicles is supplied by the hydraulic units 33 of the relay unit 30. The vehicles 50 therefore travel along the bottom 2 and pick up the ore. In each vehicle, the two trains of bucket chains 58 empty their contents onto the upper conveyor belt 67 where a first washing is carried out by means of the racks 70. This belt 67 allows through the nodules of a maximum given caliber and the sediments and retains the excessively large nodules which are discharged by the hopper 69. The second conveyor belt 68 located below the first belt receives the accepted nodules and allows through the sediments which are also expelled to the discharge hopper 69. The nodules are then conveyed by the screw 72 and the gangue is removed therefrom and the nodules are subjected to a second washing before dropping into the tank 71.

The mixture of ores and sea water collected in the tank of each vehicle is raised under the effect of the pumps 37 up to the relay 30. The arrangement of the tangential inlets 36 in the silo 32 is such that the nodules are subjected, under the whirling effect, to an additional and natural cleaning with no additional supply of power. They also undergo another sorting by means of the grid 38 and are temporarily stored inside the silo 32.

The primary pump 23 of the station 20 suck up through the raising conduit 4 the mixture of ores and sea water from the relay unit 30 and discharge this mixture through the loading conduit 33 into the surface ship.

The use of an intermediate under-water station 20 between the relay unit 30 and the ship 1 has many advantages. This station is maintained at a depth of about 300 to 350 meters below the level of the water so as to be always unaffected by the swell. In the event of a storm or a rough sea, it is sufficient to disconnect the ship 1 from the charging conduit 3 which is indicated on the surface of the water by a buoy 10 (FIG. 1). The whole of the under-water equipment can remain in position and be maintained in position by the various propulsion means which are supplied by the electric generating units 28 placed on the station 20. The position of this assembly is controlled permanently by the control and driving system 27 which is also disposed on the station 20.

Further, during the disconnection of the under-water equipment from the ship, the electric generating units 28 supply the power to the primary pumps 23 for raising the mixture of ore which is located in the conduit 4 and the silo 32 of the relay unit 30 and to the pumps 37 of said relay unit and the picking up vehicles so that the collection of the ore can continue. In this case, the raised mixture is directed through the connection box 22 and the pipes 25 to the floats 24 of the station 20 (FIG. 2) so as to be stored therein, so that the equipment can operate for a few hours after the disconnection from the ship. As soon as the floats 24 are filled, the control system 27 cuts off the supply to the pumps and the picking up vehicles until the connection to the ship can again be achieved.

This arrangement therefore avoids the dismantling of the under-water equipment in the event of bad weather and maintains a sufficient yield of picked up ore.

What is claimed is:

1. Equipment for extracting ore from sea bottoms at great depth comprising (a) a surface ship (1) carrying means for supplying power required for the operation of an under-water part of said equipment and for storing the ore;

(b) a relay unit (30) disposed at a given height above sea bottom, said relay unit comprising ore storing, sorting and intermediate washing means, and means for raising said ore;

(c) an intermediate under-water station (20) interposed between said surface ship and said relay unit, an ore raising conduit (4) connecting said under-water station to said relay unit, and a charging conduit (3) connecting said intermediate station to said ship; and (d) at least one vehicle (50) for travelling along said sea bottom and comprising a propulsion system and a system for picking up, washing and treating the ore;

(e) wherein said intermediate under-water station, immersed at a given depth below the level of the water so as to be always unaffected by the swell, comprises independent means for maintaining in operation said relay unit and said at least one vehicle and for ensuring the raising and the storing of the ore in the event of a disconnection of said under-water station from said surface ship.

2. Equipment according to claim 1, wherein said independent means of said under-water station comprise (a) primary pump means capable of pumping the ore from said relay unit;

(b) longitudinal float means also acting as buffer storage means for the ore;

(c) at least one reserve electric generating unit supplying power required for the operation of said under-water station, said relay unit and said at least one vehicle;

(d) a system of longitudinal and vertical propulsion means for maintaining the course and the altitude of said under-water station; and (e) a system for controlling and driving said pump means and said propulsion means.

3. Equipment according to claim 2, comprising a connection box and pipe means connecting said longitudinal float means to said connection box, said connection box connecting said ore raising conduit and said charging conduit.

4. Equipment according to claim 1, wherein said relay unit further comprises (a) a control and driving device capable of performing a number of pre-programmed functions and carrying out instructions given from the ship or said under-water station through the control system;

(b) an assembly of propulsion means and vertical stabilizers for keeping a course relative to said under-water station; and (c) hydraulic units supplying water under pressure required for the operation of hydraulic motors of said vehicles, and electric motors drivingly connected to said hydraulic units.

5. Equipment according to claim 4, wherein the ore storing, sorting and washing means of said relay unit comprise a silo mounted on a platform.

6. Equipment according to claim 5, wherein said silo comprises in an upper part thereof tangentially-disposed multiple inlets for creating within said silo a natural whirling effect, each of said inlets being connected through a pump to a pipe for raising the ore from a said up vehicle.

7. Equipment according to claim 6, wherein a grid in the shape of a downwardly convergent cone is placed inside said silo and below said inlets so as to sort out the ore by the effect of gravity.

8. Equipment according to claim 7, wherein the conduit for raising said ore to the ship through said under-water station extends into said silo and opens out above said grid.

9. Equipment according to claim 1, comprising, for each vehicle, bucket chain trains, and a system for treating the ore picked up by bucket chain trains and comprising (a) an assembly of superimposed conveyor belts which effect the sorting out of the ore by rejecting through a hopper non-selected ore and sediments, (b) a screw disposed under said conveyor belts which removes the gangue of the ore and empties it into a tank; and (c) washing racks disposed above said conveyor belts.

10. Equipment according to claim 9, wherein said conveyor belts are formed by a grid arrangement having calibrated gaps.

11. Equipment according to claim 9, wherein said tank is connected to a pipe for raising the ore up to a silo of said relay unit.

* * * * *